US006730231B2

(12) United States Patent
Putvinski

(10) Patent No.: US 6,730,231 B2
(45) Date of Patent: May 4, 2004

(54) PLASMA MASS FILTER WITH AXIALLY OPPOSED PLASMA INJECTORS

(75) Inventor: Sergei Putvinski, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 10/115,216

(22) Filed: Apr. 2, 2002

(65) Prior Publication Data

US 2003/0183581 A1 Oct. 2, 2003

(51) Int. Cl.[7] ..... B03C 1/00

(52) U.S. Cl. ..... 210/695; 210/748; 210/787; 210/175; 210/222; 210/223; 210/243; 210/512.1; 422/186.01; 422/186.02; 209/12.1; 209/727; 204/156; 96/1; 96/2; 96/3; 95/28

(58) Field of Search ..... 210/695, 748, 210/175, 222, 223, 243, 512.1, 787; 422/186.01, 186.02; 209/12.1, 727; 204/156; 96/1, 2, 3; 95/28

(56) References Cited

U.S. PATENT DOCUMENTS 3,722,677 A * 3/1973 Lehnert ..... 210/223
4,431,901 A 2/1984 Hull
5,225,740 A 7/1993 Ohkawa et al.
5,250,773 A 10/1993 Lind et al.
5,361,016 A 11/1994 Ohkawa et al.
5,560,844 A 10/1996 Boulos et al.
5,611,947 A 3/1997 Vavruska
6,096,220 A 8/2000 Ohkawa
6,235,202 B1 * 5/2001 Ohkawa ..... 210/695
6,248,240 B1 * 6/2001 Ohkawa ..... 210/695
6,258,216 B1 7/2001 Ohkawa
6,303,007 B1 10/2001 Ohkawa
6,322,706 B1 * 11/2001 Ohkawa ..... 210/695
6,326,627 B1 12/2001 Putvinski et al.
6,396,223 B1 * 5/2002 Ohkawa ..... 204/156

* cited by examiner

*Primary Examiner*—David A. Reifsnyder
(74) *Attorney, Agent, or Firm*—Nydegger & Associates

(57) ABSTRACT

A device for separating the constituents of a multi-constituent material includes a substantially cylindrical plasma chamber and two, axially opposed plasma injectors. The injectors convert the multi-constituent material into a multi-species plasma and inject the multi-species plasma into a core portion of the plasma chamber. Ions in the plasma diffuse from the core portion to an annular volume within the chamber where the ions are separated according to their respective mass to charge ratios. To effect separation, electrodes and coils are provided to establish crossed electric and magnetic fields in the annular volume. With the crossed electric and magnetic fields, low-mass ions in the annular volume are placed on small orbit trajectories and drift axially for capture at the ends of the plasma chamber. High-mass ions in the annular volume are placed on large orbit trajectories for capture at the cylindrical wall of the chamber.

17 Claims, 2 Drawing Sheets

PLASMA MASS FILTER WITH AXIALLY OPPOSED PLASMA INJECTORS

FIELD OF THE INVENTION

The present invention pertains generally to devices and methods for separating and segregating the constituents of a multi-constituent material. More particularly, the present invention pertains to devices for efficiently initiating and maintaining a multi-species plasma in one portion of a chamber and then separating the ions in the multi-species plasma according to their respective mass to charge ratios in a second portion of the chamber. The present invention is particularly, but not exclusively, useful as a high-throughput filter to separate the high-mass particles from the low-mass particles in a plasma chamber having two, axially opposed plasma injectors.

BACKGROUND OF THE INVENTION

There are many reasons why it may be desirable to separate and segregate a multi-constituent material into its separate constituents. One such application where it may be desirable to separate a multi-constituent material is in the treatment and disposal of hazardous waste. For example, it is well known that of the entire volume of nuclear waste, only a small amount of the waste consists of radionuclides that cause the waste to be hazardous. Thus, if the radionuclides can somehow be separated from the non-hazardous ingredients of the nuclear waste, the handling and disposal of the radioactive components can be greatly simplified and the associated costs reduced.

Indeed, many different types of devices, which rely on different physical phenomena, have been proposed to separate mixed materials. For example, settling tanks which rely on gravitational forces to remove suspended particles from a solution and thereby segregate the particles are well known and are commonly used in many applications. As another example, centrifuges which rely on centrifugal forces to separate substances of different densities are also well known and widely used. In addition to these more commonly known methods and devices for separating materials from each other, there are also devices which are specifically designed to handle special materials. A plasma centrifuge is an example of such a device.

As is well known, a plasma centrifuge is a device which generates centrifugal forces to separate charged particles in a plasma from each other. For its operation, a plasma centrifuge necessarily establishes a rotational motion for the plasma about a central axis. A plasma centrifuge also relies on the fact that charged particles (ions) in the plasma will collide with each other during this rotation. The result of these collisions is that the relatively high-mass ions in the plasma will tend to collect at the periphery of the centrifuge. On the other hand, these collisions will generally exclude the lower mass ions from the peripheral area of the centrifuge. The consequent separation of high-mass ions from the relatively lower mass ions during the operation of a plasma centrifuge, however, may not be as complete as is operationally desired, or required.

Apart from a centrifuge operation, it is well known that the orbital motions of charged particles (ions) in a magnetic field, or in crossed electric and magnetic fields, will differ from each other according to their respective mass to charge ratio. Thus, when the probability of ion collision is significantly reduced, the possibility for improved separation of the particles due to their orbital mechanics is increased. For example, U.S. Pat. No. 6,096,220, which issued on Aug. 1, 2000 to Ohkawa, for an invention entitled "Plasma Mass Filter" and which is assigned to the same assignee as the present invention, discloses a device which relies on the different, predictable, orbital motions of charged particles in crossed electric and magnetic fields in a chamber to separate the charged particles from each other. In the filter disclosed in Ohkawa '220, the magnetic field is oriented axially, the electric field is oriented radially and outwardly from the axis, and both the magnetic field and the electric field are substantially uniform both azimuthally and axially. As further disclosed in Ohkawa '220, this configuration of fields causes ions having relatively low-mass to charge ratios to be confined inside the chamber during their transit of the chamber. On the other hand, ions having relatively high-mass to charge ratios are not so confined. Instead, these larger mass ions are collected inside the chamber before completing their transit through the chamber. The demarcation between high-mass particles and low-mass particles is a cut-off mass $M_c$ which is established by setting the magnitude of the magnetic field strength, $B_0$, the positive voltage along the longitudinal axis, $V_{axis}$, and the radius of the cylindrical chamber, "a". $M_c$ for this configuration can then be determined with the expression:

$$M_c = ea^2(B_0)^2/8V_{axis}.$$

In the filter disclosed in Ohkawa '220, a multi-species plasma is introduced into one end of a cylindrical chamber for interaction with the crossed electric and magnetic fields. As further disclosed in Ohkawa '220, the fields can be configured to cause ions having relatively high-mass to charge ratios to be placed on unconfined orbits. These ions are directed toward the cylindrical wall for collection. On the other hand, ions having relatively low-mass to charge ratios are placed on confined orbits inside the chamber. These ions transit through the chamber toward the ends of the chamber. It can happen, however, that some low-mass ions, as they undergo separation, are directed toward the end where the multi-species plasma is being introduced into the chamber. This allows the low-mass ions to be re-mixed with the multi-species plasma, lowering the separation efficiency of the plasma mass filter.

One way to overcome the end loss described above is to use a tandem plasma mass filter. Specifically, U.S. Pat. No. 6,235,202, which issued on May 22, 2001 to Ohkawa, for an invention entitled "Tandem Plasma Mass Filter" and which is assigned to the same assignee as the present invention, discloses a device wherein the feed material is introduced midway between the ends of a cylindrical plasma chamber. After separation in the plasma chamber, the light ions are collected at both ends of the cylindrical chamber. Because a plasma needs to be created near the center of the plasma chamber, the tandem mass filter requires a high density vapor jet or some other injector to introduce vapor into the chamber. Once the vapor is introduced into the chamber, an r-f antenna or some other mechanism is required to heat and ionize the vapor. The present invention reduces the end loss problem in a different way than the tandem plasma mass filter. Specifically, the present invention contemplates maintaining a multi-species plasma in one portion of a plasma chamber and then separating the ions in the multi-species plasma according to their respective mass to charge ratios in a second portion of the chamber. Because of the location of the second portion of the chamber and the configuration of the crossed electric and magnetic fields, the ions are not directed toward the first portion of the chamber during separation, and there is little re-mixing of separated ions.

In light of the above, it is an object of the present invention to provide devices for efficiently initiating and maintaining a multi-species plasma in one portion of a plasma chamber and then separating the ions in the multi-species plasma according to their respective mass to charge ratios in a second portion of the chamber. It is another object of the present invention to provide an efficient, high-throughput filter to separate the high-mass particles from the low-mass particles with little or no re-mixing of separated ions. It is yet another object of the present invention to provide a filter to separate the high-mass particles from the low-mass particles in a plasma chamber that accommodates two, axially opposed plasma injectors. Yet another object of the present invention is to provide devices and methods for separating and segregating the constituents of a multi-constituent material which are easy to use, relatively simple to implement, and comparatively cost effective.

SUMMARY OF THE INVENTION

In overview, the present invention is directed to devices and methods for separating and segregating the constituents of a multi-constituent material. In particular, for the operation of the present invention, a multi-species plasma is first created from the multi-constituent material and introduced into a first portion of a plasma chamber using two, axially opposed plasma injectors. Once the multi-species plasma is established in the first portion, ions in the plasma diffuse into a second portion of the plasma chamber where the ions are separated according to their respective mass to charge ratios by their interaction with crossed electric and magnetic fields.

In greater detail, the device in accordance with the present invention includes a chamber having a substantially cylindrical wall that extends between a first end of the chamber and a second end of the chamber. The cylindrical wall is centered on a longitudinal axis. Primary magnetic coils are selectively arranged on the outside of the chamber wall and are activated to generate a substantially uniform magnetic field, $B_0$, inside the chamber that is oriented substantially parallel to the longitudinal axis.

An injector is provided at each end of the plasma chamber to create a multi-species plasma from the multi-constituent material and inject the multi-species plasma into the plasma chamber. Each injector includes a first section for evaporating the multi-constituent material and a second section for heating and ionizing the resulting vapors. The ionization and heating creates a multi-species plasma having ions of relatively high-mass to charge ratio ($M_1$) and ions of relatively low-mass to charge ratio ($M_2$). In greater structural detail, the second section of the injector includes a substantially cylindrical wall having a first end for receiving vapors and a second end for emitting a plasma jet. Preferably, a radio-frequency (rf) antenna is provided to heat and ionize vapors in the second section of the injector. Importantly, the diameter of the cylindrical injector wall is smaller than the diameter of the cylindrical wall of the plasma chamber.

For the present invention, the injectors are positioned at the ends of the plasma chamber with the cylindrical walls of the injectors centered on the longitudinal axis of the plasma chamber. With this cooperation of structure, the plasma jets emitted by the injectors are directed along the longitudinal axis of the plasma chamber. In greater detail, the opposed injectors establish and maintain a multi-species plasma in a core portion of the plasma chamber. The core portion is a substantially cylindrical volume, centered on the longitudinal axis of the plasma chamber and extending from the first end of the plasma chamber to the second end of the plasma chamber. In size, the core portion has an approximate diameter equal to the diameter of the cylindrical walls of the injectors.

Within the plasma chamber, the core portion is surrounded by an annular volume that extends from the core portion to the cylindrical wall of the plasma chamber. During operation of the present invention, ions of the multi-species plasma diffuse radially from the core portion into the annular volume where they are separated according to their respective mass to charge ratios using crossed electric and magnetic fields. As indicated above, an axially aligned magnetic field, $B_0$, is established inside the plasma chamber (in both the core portion and the annular volume) by the primary coils. Additionally, the device includes one or more primary electrodes for creating a radially oriented electric field in the annular volume portion of the plasma chamber. Specifically, the primary electrode(s) are positioned at the end(s) of the plasma chamber between the wall of the injector and the wall of the plasma chamber. With this cooperation of structure, the primary electrode(s) establish a positive voltage ($V_{ctr}$) at the cylindrical boundary between the core portion and the annular volume, and a substantially zero potential at the wall of the chamber. Importantly, the primary electrodes create little or no electric field within the core portion of the plasma chamber.

During operation of the present invention, ions from the plasma that is established in the core portion of the plasma chamber diffuse into the annular volume. Once the ions reach the annular volume, they are separated according to their respective mass to charge ratio by the crossed electric and magnetic fields. Specifically, in the crossed fields, an ion having a relatively low-mass to charge ratio ($M_2$) is confined inside the chamber during its transit of the chamber. As such, the low-mass ions ($M_2$) move toward one of the ends of the chamber and strike one of the primary electrodes for collection. On the other hand, in the crossed fields, an ion having a relatively high-mass to charge ratio ($M_1$) is not so confined. Instead, these larger mass ions strike a collector mounted on the inside of the chamber wall before completing their transit through the chamber. Specifically, for a chamber wall that has a radius "a" and a core portion that has a radius "d", ions having a mass ($M_1$) that is greater than a cut-off mass, $M_c$ ($M_1>M_c$) will be collected at the chamber wall, where $$M_c=eB_0^2(a^2-d^2)/8V_{ctr}.$$

Here "e" is the ion charge. Ions having a mass ($M_2$) that is less than a cut-off mass, $M_c$ ($M_2<M_c$) will transit through the chamber and be collected at the primary electrodes.

A number of modifications can be made to the device described above to increase the rate at which the ions diffuse from the core portion to the annular portion of the plasma chamber (i.e. the ion loss rate). By increasing the ion loss rate, the overall throughput of the device can be increased. One way to increase the ion loss rate from the core portion is to apply a small radial electric field within the core portion using one or more secondary electrodes. The resulting friction force between rotating ions and neutrals will cause ion drift in the radial direction. As detailed further below, the magnitude of this radial electric field must be limited to prevent ion separation from occurring within the core portion. In another modification to increase the ion loss rate, secondary coils are provided to create a magnetic mirror at each end of the cylindrical core portion. As detailed further below, these magnetic mirrors create a plasma instability in the core portion that increases the rate at which the ions diffuse from the core portion to the annular volume.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
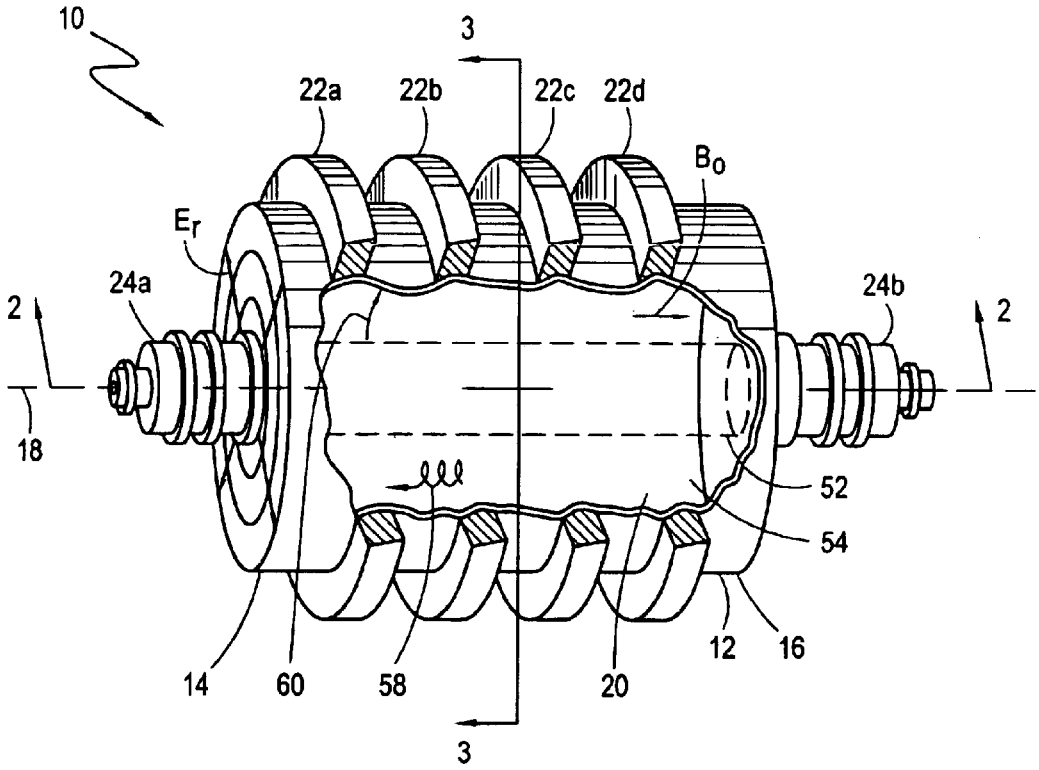
FIG. 1 is a perspective view of a plasma mass filter in accordance with the present invention.

Referring initially to FIG. 1, a plasma mass filter in accordance with the present invention is shown and generally designated 10. As shown, the filter 10 includes an enclosing chamber wall 12 that extends from a first end 14 to a second end 16. As further shown, the chamber wall 12 is preferably formed as an elongated cylinder that is centered on a longitudinal axis 18. It is further shown that the chamber wall 12 surrounds a cylindrical chamber 20.

Referring still to FIG. 1, it can be seen that coils 22*a–d* are positioned on the outside of chamber wall 12 to generate a uniform magnetic field, $B_0$, throughout the chamber 20. In accordance with the present invention, the magnetic field, $B_0$, is uniform both azimuthally and axially, and is directed substantially parallel to the longitudinal axis 18. It is to be appreciated that size, shape, number and type of coil shown in FIG. 1 is merely exemplary and that any devices and methods known in the pertinent art for establishing a uniform magnetic field in a chamber can be substituted in place of the coils 22*a–d* for use in the present invention.

Referring still to FIG. 1, it can be seen that the filter 10 includes an injector 24*a* positioned at the first end 14 of the chamber wall 12, and an injector 24*b* positioned at the second end 16 of the chamber wall 12. In accordance with the present invention, each injector 24*a, b* is provided to convert a multi-constituent material into multi-species plasma and inject the multi-species plasma into the plasma chamber 20. As contemplated for the present invention, the multi-constituent material can be any of a wide variety of mixtures to include: a chemical mixture, a mixture of isotopes, a mixture containing matter that is highly radioactive or any other mixture requiring separation.

Figure 2:
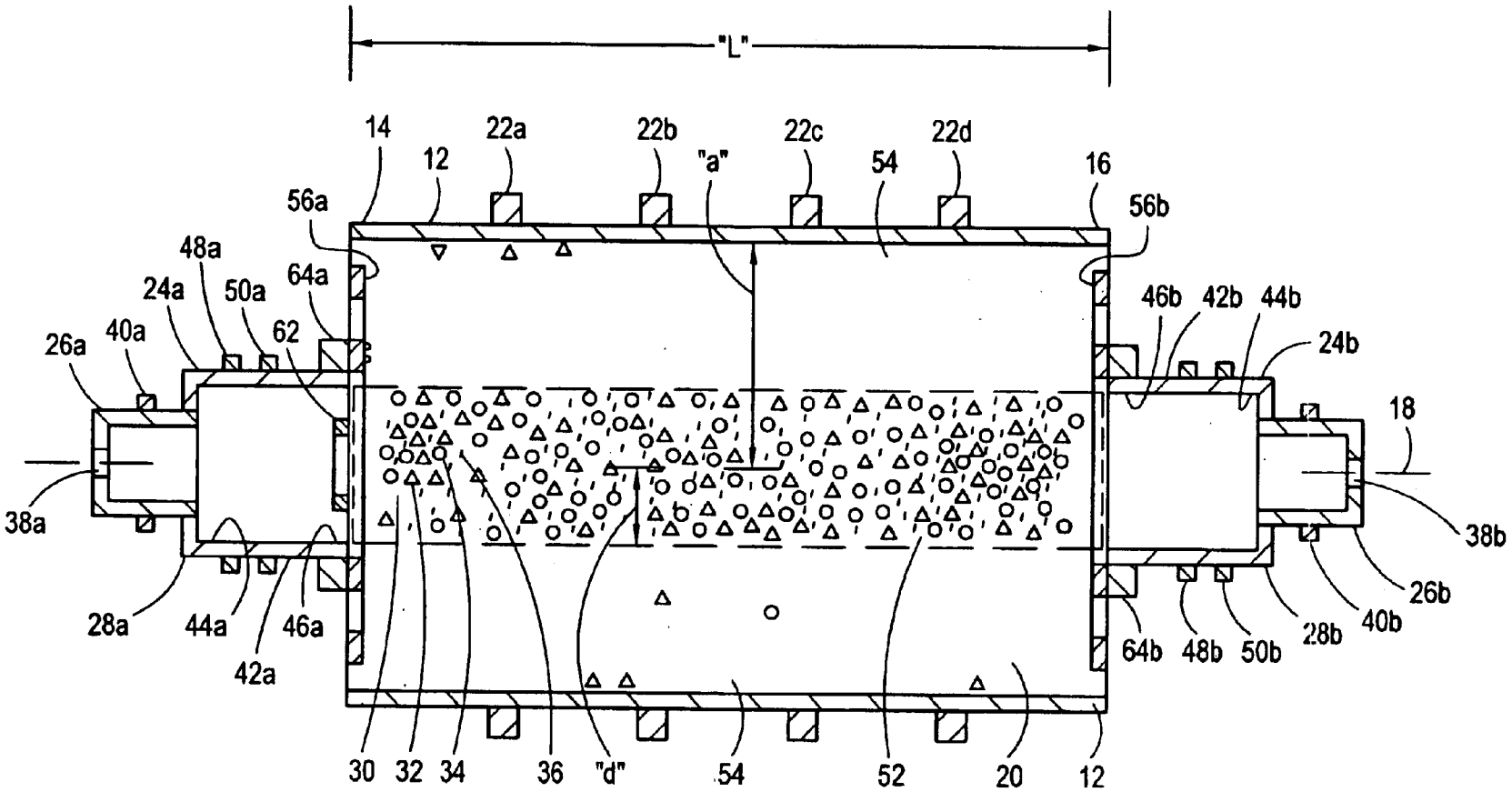
FIG. 2 is a sectional view of the plasma mass filter shown in FIG. 1 as seen along line 2—2 in FIG. 1.

Referring now with cross reference to FIGS. 1 and 2, it can be seen that each injector 24*a, b* includes a first section 26*a, b* for evaporating the multi-constituent material and a second section 28*a, b* for heating and ionizing the resulting vapors. In accordance with the present invention, the ionization and heating in the second section 28*a, b* creates a multi-species plasma 30 and injects the multi-species plasma 30 into the plasma chamber 20. As shown, the multi-species plasma 30 includes ions of relatively high-mass to charge ratio (hereinafter high-mass ions 32), ions of relatively low-mass to charge ratio (hereinafter low-mass ions 34), and free electrons 36.

In greater structural detail, the first section 26*a, b* of each injector 24*a, b* includes an inlet port 38*a, b* to allow the multi-constituent material to enter the injector 24*a, b* and a radiofrequency (rf) antenna 40*a, b* for evaporating the multi-constituent material in the first section 26*a, b*. Also shown, the second section 28*a, b* of each injector 24*a, b* includes a substantially cylindrical injector wall 42*a, b* having a first end 44*a, b* for receiving vapors from the first section 26*a, b*, and a second end 46*a, b* for emitting a plasma jet. Preferably, as shown, radio-frequency (rf) antennae 48*a, b* and 50*a, b* are provided to heat and ionize vapors in the second section 28*a, b* of each injector 24*a, b*.

As best seen in FIG. 2, the injectors 24*a, b* are preferably positioned at the ends 14, 16 of the chamber wall 12 with the cylindrical injector walls 42*a, b* centered on the longitudinal axis 18 of the plasma chamber 20. As further shown, the opposed injectors 24*a, b* establish and maintain a multi-species plasma 30 in a core portion 52 of the plasma chamber 20. As shown with cross reference to FIGS. 1 and 2, the core portion 52 is a cylindrical volume, centered on the longitudinal axis 18 of the plasma chamber 20. It is further shown that the core portion 52 extends from approximately the first end 14 of the chamber wall 12 to the second end 16 of the chamber wall 12. In size, the core portion 52 has a radius, "d", that is approximately equal to the radius of the cylindrical injector wall 42*a, b*.

With continued cross reference to FIGS. 1 and 2, it can be seen that the core portion 52 is surrounded by an annular volume 54 that extends from the core portion 52 to the cylindrical chamber wall 12. During operation of the present invention, ions 32, 34 of the multi-species plasma 30 diffuse radially from the core portion 52 into the annular volume 54 where they are separated according to their respective mass to charge ratios using crossed electric and magnetic fields. To achieve ion separation in the annular volume 54, the filter 10 includes primary electrodes 56*a, b* for creating an electric field, $E_r$, that is radially oriented within the annular volume 54. As shown in FIGS. 1 and 2, each primary electrode 56*a, b* preferably consists of a plurality of circular rings that are concentrically centered on the longitudinal axis 18. As further shown, the primary electrodes 56*a, b* are positioned at the ends 14, 16 of the chamber wall 12 and extend from the injector walls 42*a, b* to the chamber wall 12. With this cooperation of structure, the primary electrodes 56*a, b* establish a positive voltage ($V_{ctr}$) at the injector walls 42*a, b* and a substantially zero potential at the chamber wall 12. Furthermore, a substantially uniform, positive voltage ($V_{ctr}$) is established by the primary electrodes 56*a, b* in the core portion 52 of the chamber 20. Importantly, the primary electrodes 56*a, b* create little or no electric field within the core portion 52 of the plasma chamber 20.

Figure 3:
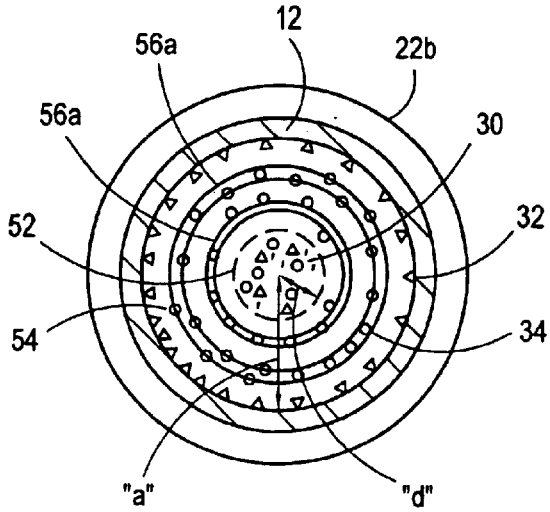
FIG. 3 is a sectional view of the plasma mass filter shown in FIG. 1 as seen along line 3—3 in FIG. 1.

The operation of the plasma mass filter 10 of the present invention can best be appreciated with initial cross-reference to FIGS. 2 and 3. Initially, the chamber 20 is first evacuated. Next, a multi-species plasma 30 is initiated and maintained in the core portion 52 of the plasma chamber 20 by the injectors 24*a, b*. Preferably, the plasma 30 in the core portion 52 is heated to an electron temperature of approximately 1–2 eV to fully ionize all metallic elements in the plasma 30. At this temperature, Hydrogen and Oxygen are not ionized. Once established in the core portion 52, high-mass ions 32 and low-mass ions 34 of the plasma 30 diffuse radially across the magnetic field lines from the core portion 52 and into the annular volume 54. As detailed further below, the rate of diffusion from the core portion 52 to the annular volume can be increased by increasing the temperature of the plasma 30 in the core portion 52 and/or by creating plasma instabilities in the core portion 52.

In response to the crossed electric and magnetic fields in the annular volume 54, low-mass ions 34 in the annular volume 54 are placed on small radius, helical trajectories (such as exemplary trajectory 58 shown in FIG. 1). As shown, the axis of the helical trajectory is substantially parallel to the longitudinal axis 18. As such, the low-mass ions 34 are confined inside the annular volume 54 of the chamber 20 during their transit of the chamber 20 and strike one of the primary electrodes 56*a, b* at one of the ends 14, 16 of the chamber 20, where they are captured. On the other hand, the crossed electric and magnetic fields place high-mass ions 32 that have diffused into the annular volume 54 on large radius, helical trajectories (such as exemplary trajectory 60 shown in FIG. 1). Thus, unlike the low-mass ions 34, the high-mass ions 32 are not confined within the annular volume 54. Instead, these high-mass ions 32 strike and are captured at the chamber wall 12 before completing their transit through the chamber 20. If desired, collectors (not shown) can be placed in the chamber 20 and at the chamber wall 12 to collect the high-mass ions 32.

In mathematical terms, for a chamber wall 12 that has a radius "a" and the core portion 52 has a radius "d", high-mass ions 32 (i.e. ions having a mass ($M_1$) that is greater than a cut-off mass, $M_c$ ($M_1>M_c$)) will be collected at the chamber wall 12, where $$M_c=e(a^2-d^2)(B_0)^2/8V_{ctr}$$

wherein "e" is the ion charge. Low-mass ions 34 (i.e. ions having a mass ($M_2$) that is less than a cut-off mass, $M_c$ ($M_2<M_c$)) will transit through the annular volume 54 and strike one of the primary electrodes 56*a, b*.

For a given filter throughput, G (moles/sec) and core portion plasma temperature, T, the minimum length, $L_{min}$, necessary to achieve steady state filter operation can be calculated. For the case where diffusion from the core portion 52 to the annular volume 54 is classical, then the diffusion rate, D, is given by:

$$D\approx[(\omega_e\tau_e)/(1+\omega_e^2\tau_e^2)]\times(T/eB_0).$$

where $\omega_e$ is the electron cyclotron frequency, $\tau_e$ is the electron collision time and T is the temperature in eV. The axial plasma velocity, $V_{||}$ is:

$$V_{||}\approx G/(\pi\ d^2n)$$

where d is the radius of core portion 52 and n is the plasma density. The diffusion loss time for ions, t, is:

$$t\approx d^2/D.$$

Thus, the length L of the core portion 52 is:

$$L\approx Vt\approx(d^2/D)V\approx G/(\pi nD).$$

Using definitions for $\tau_e$, $\omega_e$, and D, the following expression can be obtained:

$$L\approx L_{min}(1+\omega_e^2\tau_e^2);$$

where $L_{min}=19\ G/T^{5/2}$, and practical units: m, mol/s, eV have been used. These expressions show the minimum length, $L_{min}$, necessary to obtain steady state filter operation for a given filter throughput, G, and core portion plasma temperature, T. If the length, L, of the core portion 52 exceeds $L_{min}$ ($L>L_{min}$), then during injection, the plasma pressure, p, and density, n, will increase until steady state is reached. On the other hand, if the throughput, G, is too large and $L<L_{min}$, then there is no steady state regime. For example, at T≈1 eV and G≈0.1 mol/s, a minimum core portion length:

$$L_{min}=19\ G/T^{5/2}\approx 2\ m$$

is necessary to achieve steady state filter operation.

As indicated above, the rate at which the ions diffuse from the core portion 52 to the annular volume 54 of the chamber 20 can be increased by applying a radial electric field, $E_r$, in the core portion 52. The ion rotation velocity is:

$$V_{\theta,i}=E_r/B_0.$$

An additional radial ion drift will be caused by the friction force between rotating ions and non-rotating neutrals $$V_{r,i}=(\nu_{io}/\omega_i)(E_r/B_0)$$

where $\nu_{io}$ is the ion neutral collision frequency, $\omega_i=eB_0/M$–ion cyclotron frequency.

In accordance with the present invention, the ion loss from the core portion 52 can be increased by applying a supplementary electrical field ($E_r'$) within the core portion 52 using a secondary electrode 62 as shown in FIG. 2. In the preferred embodiment of the present invention, the strength of the supplementary electrical field ($E_r'$) is limited to avoid placing high-mass ions 32 in the core portion 52 of the chamber 20 on unconfined trajectories. Specifically, the quantity ($V_{axis}-V_{ctr}$), where $V_{axis}$ is a voltage potential along the longitudinal axis 18, and $V_{ctr}$ is the voltage potential at the boundary between the core portion 52 and the annular volume 54, is controlled to ensure that no high-mass ions 32 in the core portion 52 of the chamber 20 are placed on unconfined trajectories. In mathematical terms, assuming that the highest mass ions in the core portion 52 have a mass $M_2$, the quantity ($V_{axis}-V_{ctr}$) is limited to ensure that the cut-off mass ($M_c'$) in the core portion 52 is greater than $M_2$ ($M_c'>M_2$), with $$M_c'=ed^2B_0^2/8(V_{axis}-V_{ctr})$$

where "d" is the radius of the core portion 52.

In another modification of the filter 10 designed to increase the diffusion rate, secondary coils 64*a* and 64*b* are provided to create magnetic mirrors in the cylindrical core portion 52 near each end 14, 16 of the chamber wall 12, as shown in FIG. 2. For the present invention, these magnetic mirrors create a slight plasma instability in the core portion 52 (i.e. a flute instability) that increases the rate at which the ions in the plasma 30 diffuse from the core portion 52 to the annular volume 54. The loss time, $\tau_{loss}$, can be estimated:

$$\tau_{loss}\approx\sqrt{(d/g_{eff})}\approx\sqrt{((d\ M_i\ R)/T_i)}$$

where, $g_{eff}$ is equal to $T_i/M_i$ R, $M_i$ is the ion mass, $T_i$ is the ion temperature, and R is effective radius of curvature of the field line given by:

$$R\approx(L_{eff}^2/2d)/(1-(B_0/B_{max})^{1/2}).$$

Here $L_{eff}$ is the length between mirrors, $B_{max}$ is the field in the mirror, hence $$\tau_{loss}\approx(L_{eff}/V_{th})/(1-(B_0/B_{max})^{1/2})^{1/2}\approx(L_{eff}/V_{th})(2B_0/(B_{max}-B_0)^{1/2}).$$

Here $V_{th}$ is equal to $\sqrt{2T_i/M_i}$. Controlling $B_{max}\geqq B$ it can be seen that: $\tau_{loss}$ can be varied in the range:

$$L_{eff}/V_{th}<\tau_{loss}<\infty.$$

If magnetic mirrors are located in the chamber 20 near the ends 14, 16, they will not affect separation of ions between the ends 14, 16 where separation is desired. Moreover, the higher magnetic field near the injectors 24*a*, 24*b* is beneficial because it will further suppress unwanted separation near the injectors 24*a*, 24*b*.

While the particular Plasma Mass Filter With Axially Opposed Plasma Injectors as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A system for introducing a multi-species plasma into a plasma chamber for separating relatively low-mass to charge ions ($M_1$) from relatively high-mass to charge ions ($M_2$) which comprises:

a substantially cylindrical shaped chamber having a wall and defining a longitudinal axis;

an electrical means for establishing a voltage potential ($V_{ctr}$) in a substantially cylindrical shaped core column having a first end and a second end, said core column being axially aligned in said chamber to create a radially oriented electric field ($E_r$) between said core column and said wall of said chamber;

a magnetic means for generating a substantially uniform magnetic field ($B_0$), said magnetic field being axially oriented for interaction with said radial electric field, $E_r$, to create crossed electric and magnetic fields (E×B) in said chamber between said core column and said wall of said chamber; and a first injector positioned at said first end of said core column and a second injector positioned at said second end of said core column for introducing a plasma feed into said core column for ionization of said feed, and for subsequent diffusion of said plasma therefrom into said crossed electric and magnetic fields (E×B) to separate said low-mass to charge ions $M_1$ from said high-mass to charge ions $M_2$.

2. A system as recited in claim 1 further comprising a first magnetic mirror positioned at said first end of said core column and a second magnetic mirror positioned at said second end thereof to create an instability for enhanced diffusion of said plasma from said core column.

3. A system as recited in claim 1 wherein $V_{ctr}$ is a positive potential and said wall has a zero potential, and wherein a cut-off mass ($M_c$) is established between said core column and said wall with $$M_c=e(a^2-d^2)B_0^2/8V_{ctr}$$

where "e" is a particle charge and "a" is the radius of said wall and "d" is the radius of said core column, and further wherein $M_1<M_c<M_2$.

4. A system as recited in claim 3 further comprising electrical means for establishing a supplementary electrical field ($E_r'$) for heating said plasma in said core column to create an instability for enhanced diffusion of said plasma from said core column.

5. A system as recited in claim 4 wherein $E_r'$ is established for a high cut-off mass ($M_c'$) in said core column, with $$M_c'=ed^2B_0^2/8(V_{axis}-V_{ctr})$$

where said core column has a radius "d" and $V_{axis}$ is a voltage potential along said axis, and further wherein $M_1<M_c<M_2<M_c'$.

6. A system as recited in claim 1 wherein ionization of said feed is accomplished by heating said feed to an electron temperature in a range between one and two electron volts (1–2 eV).

7. A system as recited in claim 1 wherein said core column has a length of approximately two meters.

8. A system for separating relatively low-mass to charge ions ($M_1$) from relatively high-mass to charge ions ($M_2$), said system comprising:

an enclosing wall surrounding a volume, said volume having a first portion and a second portion;

a means for introducing said low-mass ions ($M_1$) and said high-mass ions ($M_2$) into said first portion of said volume for subsequent diffusion therefrom into said second portion of said volume;

a means for establishing a first magnetic mirror and a second magnetic mirror in said first portion of said volume to create an instability for enhanced diffusion of said low-mass ions ($M_1$) and said high-mass ions ($M_2$) from said first portion of said volume into said second portion of said volume;

a magnetic means for generating a substantially uniform magnetic field ($B_0$) in said volume; and an electrical means for establishing an electric field in said volume to create crossed electric and magnetic fields (E×B) in said second portion of said volume to separate said low-mass ions $M_1$ from said high-mass ions $M_2$ therein by placing said high-mass ions ($M_2$) on unconfined orbits for capture by said enclosing wall and placing said low-mass ions ($M_1$) on confined orbits for transit through said volume, said electrical means configured to prevent said high-mass ions ($M_2$) in said first portion of said volume from being placed on unconfined orbits.

9. A system as recited in claim 8 wherein said enclosing wall is substantially cylindrically shaped and defines a longitudinal axis.

10. A system as recited in claim 9 wherein said magnetic field is axially oriented throughout said volume.

11. A system as recited in claim 10 wherein said electric field is radially oriented.

12. A system as recited in claim 9 wherein a boundary separates said first portion and said second portion of said volume, and wherein said electrical means establishes a positive potential, $V_{ctr}$ at said boundary and a zero potential at said enclosing wall, and wherein a cut-off mass ($M_c$) is established in said second portion of said volume, with $$M_c=e(a^2-d^2)B_0^2/8V_{ctr}$$

where "e" is the ion charge and "a" is the radius of said wall and "d" is the radius of said boundary, and further wherein $M_1<M_c<M_2$.

13. A system as recited in claim 8 wherein said introducing means comprises a first injector positioned along said longitudinal axis and an opposed second injector positioned along said longitudinal axis.

14. A method for introducing a multi-species plasma into a plasma chamber for separating relatively low-mass to charge ions ($M_1$) from relatively high-mass to charge ions ($M_2$), said method comprising the steps of:

providing a substantially cylindrical shaped chamber having a wall and defining a longitudinal axis;

establishing a voltage potential ($V_{ctr}$) in a substantially cylindrical shaped core column, wherein said core column has a first end and a second end, said core column being axially aligned in said chamber to create a radially oriented electric field ($E_r$) between said core column and said wall of said chamber;

generating a substantially uniform magnetic field ($B_0$), said magnetic field being axially oriented for interaction with said radial electric field, ($E_r$), to create crossed electric and magnetic fields (E×B) in said chamber between said core column and said wall of said chamber;

injecting a plasma feed into said core column for ionization of said feed, and for subsequent diffusion of said plasma therefrom into said crossed electric and magnetic fields (E×B) to separate said low-mass ions $M_1$ from said high-mass ions $M_2$; and establishing a first magnetic mirror positioned at said first end of said core column and a second magnetic mirror positioned at said second end thereof to create an instability for enhanced diffusion of said plasma from said core column.

15. A method as recited in claim 14 wherein $V_{ctr}$ is a positive potential and said wall has a zero potential, and wherein a cut-off mass ($M_c$) is established between said core column and said wall with $$M_c=e(a^2-d^2)B_0^2/8V_{ctr}$$

where "e" is a particle charge and "a" is the radius of said wall and "d" is the radius of said core column, and further wherein $M_1<M_c<M_2$.

16. A method as recited in claim 14 further comprising the step of establishing a supplementary electrical field ($E_r'$) for heating said plasma in said core column to create an instability for enhanced diffusion of said plasma from said core column.

17. A method as recited in claim 14 wherein said core column has a length of approximately two meters.

* * * * *